US009657560B2

(12) United States Patent
Nguyen et al.

(10) Patent No.: US 9,657,560 B2
(45) Date of Patent: May 23, 2017

(54) METHODS FOR FORMING PROPPANT-FREE CHANNELS IN PROPPANT PACKS IN SUBTERRANEAN FORMATION FRACTURES

(71) Applicant: Halliburton Energy Services, Inc., Houston, TX (US)

(72) Inventors: Philip D. Nguyen, Houston, TX (US); Max L. Phillippi, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 107 days.

(21) Appl. No.: 13/926,141

(22) Filed: Jun. 25, 2013

(65) Prior Publication Data

US 2014/0374093 A1 Dec. 25, 2014

(51) Int. Cl.
*E21B 43/267* (2006.01)
*C09K 8/80* (2006.01)

(52) U.S. Cl.
CPC ..... *E21B 43/267* (2013.01)

(58) Field of Classification Search
CPC ..... E21B 43/26; E21B 43/267; E21B 21/062; B01F 5/045; B01F 3/0865
USPC ..... 166/280.1, 280.2, 308.5, 75.15
See application file for complete search history.

(56) References Cited

U.S. PATENT DOCUMENTS 2,383,946 A * 9/1945 Tietig ..... B01F 3/04269 118/DIG. 11
2,899,374 A * 8/1959 Gomory ..... B01J 8/0015 137/896
4,344,485 A * 8/1982 Butler ..... 166/271
5,026,168 A * 6/1991 Berryman ..... B01F 7/1675 366/171.1
5,799,734 A * 9/1998 Norman et al. ..... 166/278
6,488,091 B1 12/2002 Weaver et al.
7,261,158 B2 8/2007 Middaugh et al.
7,281,581 B2 10/2007 Nguyen et al.
7,581,590 B2 9/2009 Lesko et al.
(Continued)

FOREIGN PATENT DOCUMENTS

EP 2175004 A1 4/2010
WO 2014209730 12/2014

OTHER PUBLICATIONS

International Search Report and Written Opinion for PCT/US2014/043091 dated Oct. 13, 2014.

*Primary Examiner* — Angela M DiTrani
*Assistant Examiner* — Avi Skaist
(74) *Attorney, Agent, or Firm* — McDermott Will & Emery LLP

(57) ABSTRACT

Methods of treating a fracture in a subterranean formation including providing a proppant-free fluid comprising a first gelling agent; providing a proppant fluid comprising a second gelling agent and proppant aggregates, wherein the proppant-free fluid and the proppant fluid are substantially immiscible; continuously pumping the proppant-free fluid into the subterranean formation; continuously pumping the proppant fluid into the subterranean formation, wherein the proppant-free fluid and the proppant fluid are present simultaneously in a portion of the subterranean formation but remain immiscible; placing the proppant aggregates into a portion of the fracture in the subterranean formation so as to form a proppant pack having proppant-free channels therein.

20 Claims, 1 Drawing Sheet

(56) References Cited

U.S. PATENT DOCUMENTS

| | | | | |
|---|---|---|---|---|
| 8,066,068 | B2 | 11/2011 | Lesko et al. | |
| 2005/0016732 | A1 | 1/2005 | Brannon et al. | |
| 2005/0274523 | A1* | 12/2005 | Brannon et al. | 166/308.3 |
| 2006/0048943 | A1* | 3/2006 | Parker et al. | 166/308.1 |
| 2006/0073980 | A1 | 4/2006 | Brannon et al. | |
| 2006/0289160 | A1* | 12/2006 | van Batenburg et al. | 166/280.2 |
| 2010/0089581 | A1 | 4/2010 | Nguyen et al. | |
| 2010/0197528 | A1 | 8/2010 | Sanders et al. | |
| 2010/0282464 | A1 | 11/2010 | Medvedev et al. | |
| 2011/0036583 | A1* | 2/2011 | Willberg et al. | 166/308.1 |
| 2011/0067868 | A1 | 3/2011 | Le Roy-Delage et al. | |
| 2011/0083849 | A1 | 4/2011 | Medvedev et al. | |
| 2012/0175798 | A1* | 7/2012 | Fukuda | B29B 9/10 264/5 |
| 2013/0043031 | A1* | 2/2013 | Tunget | 166/313 |

* cited by examiner

METHODS FOR FORMING PROPPANT-FREE CHANNELS IN PROPPANT PACKS IN SUBTERRANEAN FORMATION FRACTURES

BACKGROUND

The present invention relates to methods for forming proppant-free channels in proppant packs in subterranean formation fractures.

Subterranean wells (such as hydrocarbon producing wells, water producing wells, and the like) are often stimulated by hydraulic fracturing treatments. In hydraulic fracturing treatments, a treatment fluid is pumped into a portion of a subterranean formation at a rate and pressure such that the subterranean formation breaks down and one or more fractures are formed. Typically, particulates, such as graded sand, are then deposited in the fractures. These particulate solids, or "proppant particulates" or "proppant," serve to prevent the fractures from fully closing once the hydraulic pressure is removed. By keeping the fracture from fully closing, the proppant particulates aid in forming conductive paths through which fluids may flow.

Commonly used proppant particulates generally comprise substantially spherical particles, such as graded sand, bauxite, ceramics, or even nut hulls. Generally, the proppant particulates are placed in the fracture in a concentration such that they form a tight pack of particulates. Unfortunately, in such traditional operations, when fractures close upon the proppant particulates they can crush or become compacted, potentially forming non-permeable or low permeability masses within the fracture rather than desirable high permeability masses. Such low permeability masses may choke the flow path of the fluids within the formation. Furthermore, the proppant particulates may become embedded in particularly soft formations, negatively impacting production.

The degree of success of a fracturing operation depends, at least in part, upon fracture porosity and conductivity once the fracturing operation is stopped and production is begun. Traditional fracturing operations place a large volume of proppant particulates into a fracture and the porosity of the resultant packed propped fracture is then related to the interconnected interstitial spaces between the abutting proppant particulates. Thus, the resultant fracture porosity from a traditional fracturing operation is closely related to the strength of the placed proppant particulates (if the placed proppant crushes, then the pieces of broken proppant may plug the interstitial spaces) and the size and shape of the placed proppant (larger, more spherical proppant particulates generally yield increased interstitial spaces between the particulates).

One way proposed to combat problems inherent in tight proppant packs involves the placement of proppant aggregates comprised of multiple individual proppant particulates. The larger size of the proppant aggregates allows a reduced volume of proppant to be placed into the fracture while maintaining the structural integrity required to keep the fracture from closing and crushing the proppant aggregates. Additionally, the spaces between the proppant aggregates through which produced fluids may flow may be larger than the interstitial spaces that would be present between individual proppant particulates.

Another method proposed to combat problems inherent in tight spaces is to pump a substantially solids free fluid intermittently between pumping proppant particulates and/or proppant aggregates. The solids free fluid forms spaces within the proppant pack by preventing individual proppant particulates and/or proppant aggregates from gathering particularly close to one another. These spaces, or "proppant free channels," form conductive channels through which produced fluids may flow. However, such intermittent pumping may be deleterious to operational equipment, as it requires the constant turning on and off of the equipment. Additionally, the intermittent pumping may cause additives in either the solids free fluid or other treatment fluids to settle out during the constant pressure changes (i.e., as the pumping equipment is stopped and begun again) and/or deposition of the additives in undesired locations in the subterranean formation.

Therefore, a method of forming proppant free channels in a proppant pack without causing equipment damage or negative effects on treatment fluids may be of benefit to one of ordinary skill in the art.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1A:
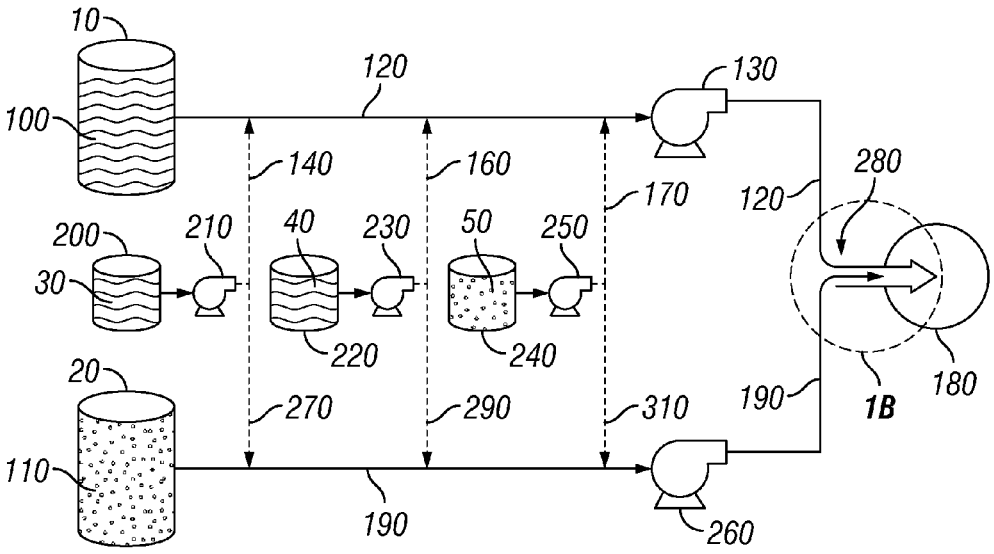
FIG. 1A is a schematic view of an equipment embodiment of the methods of the present invention for delivering proppant-free fluid and proppant fluid simultaneously into a wellbore as could be used in the field.

The present invention relates to methods for forming proppant-free channels in proppant packs in subterranean formation fractures.

Specifically, the present invention relates to methods of forming proppant-free channels using a two fluid system, in which both fluids are simultaneously pumped into the wellbore such that there is no need to pulse either of the fluids through operational equipment. Moreover, the methods of the present invention eliminate the need for a frac blender in the field, as a liquid mixture could be used, as is described in U.S. Pat. No. 7,261,158, the entire disclosure of which is hereby incorporated by reference.

While compositions and methods are described herein in terms of "comprising" various components or steps, the compositions and methods can also "consist essentially of" or "consist of" the various components and steps. When "comprising" is used in a claim, it is open-ended. Additionally, one or more illustrative embodiments incorporating the invention disclosed herein are presented below. Not all features of an actual implementation are described or shown in this application for the sake of clarity. It is understood that in the development of an actual embodiment incorporating the present invention, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill the art having benefit of this disclosure.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claim, each numerical parameter should at least be construed in light of the number of reported significant digits and by applying ordinary rounding techniques.

In some embodiments, the present invention provides for a method of treating a fracture in a subterranean formation. A proppant-free fluid comprising a first gelling agent and a proppant fluid comprising a second gelling agent and proppant aggregates are continuously pumped into the subterranean formation such that the proppant-free fluid and the proppant fluid are present simultaneously in at least a portion of the subterranean formation. The gelling agent and the second gelling agent are selected so as to render the proppant-free fluid and the proppant fluid substantially immiscible with one another. The proppant aggregates are placed into a portion of the fracture so as to form a proppant pack having proppant-free channels therein. In some embodiments, the proppant-free fluid is pumped at a rate and pressure sufficient to create or enhance the fracture in the subterranean formation.

The proppant aggregates form pillars or islands in the fractures and the proppant-free fluid, which is immiscible with the proppant fluid, functions as a spacer between the proppant aggregates in the fractures, which become open channels surrounding the proppant aggregates once the proppant-free fluid is removed from the subterranean formation. Produced fluids may then freely flow through the open proppant free channels and to the surface of the wellbore for collection.

The proppant-free fluids and proppant fluids of the present invention may be any fluid suitable for use in a subterranean operation including, but not limited to an aqueous gel; a viscoelastic surfactant gel; an oil gel; a foamed gel; and emulsions. Suitable aqueous gels are generally comprised of water and one or more gelling agents. Suitable emulsions can be comprised of two immiscible liquids such as an aqueous fluid and a gelling agent and a hydrocarbon. Foams can be created by the addition of a gas, such as carbon dioxide or nitrogen. The water used to form the proppant-free fluid and/or the proppant fluid may be saltwater (e.g., water containing one or more salts dissolved therein); brine (e.g., saturated salt water); seawater; and any combination thereof.

The first and second gelling agents of the present invention may comprise natural polymers; synthetic polymers; and any combination thereof. The gelling agents in the proppant fluid may provide a viscous environment to suspend the proppant aggregates and may also serve to prevent or minimize the breakdown of the proppant aggregates as they are pumped into the subterranean formation by reducing collisions between the proppant aggregates themselves and the formation.

A variety of gelling agents can be used in conjunction with the methods of the present invention, including, but not limited to, hydratable polymers that contain one or more functional groups such as hydroxyl, cis-hydroxyl, carboxylic acids, derivatives of carboxylic acids, sulfate, sulfonate, phosphate, phosphonate, amino, or amide. In certain exemplary embodiments, the gelling agents may be polymers comprising polysaccharides, and derivatives thereof that contain one or more of these monosaccharide units: galactose, mannose, glucoside, glucose, xylose, arabinose, fructose, glucuronic acid, or pyranosyl sulfate. Examples of suitable polymers include, but are not limited to, guar gum and derivatives thereof, such as hydroxypropyl guar and carboxymethylhydroxypropyl guar, and cellulose derivatives, such as hydroxyethyl cellulose. Additionally, synthetic polymers and copolymers that contain the above-mentioned functional groups may be used. Examples of such synthetic polymers include, but are not limited to, polyacrylate, polymethacrylate, polyacrylamide, polyvinyl alcohol, and polyvinylpyrrolidone. In other exemplary embodiments, the gelling agent molecule may be depolymerized. The term "depolymerized," as used herein, generally refers to a decrease in the molecular weight of the gelling agent molecule. Depolymerized gelling agent molecules are described in U.S. Pat. No. 6,488,091, the entire disclosure of which is incorporated herein by reference. Any gelling agent may be selected for use in the proppant-free fluids and the proppant fluids of the present invention, provided that the gelling agents are selected so as to render the proppant-free fluids and the proppant fluids substantially immiscible with one another. Suitable gelling agents generally are present in the proppant-free fluids and proppant fluids of the present invention in an amount in the range of from about 0.01% to about 5% by weight of the liquid component therein. In certain preferred embodiments, the gelling agents are present in the proppant-free fluids and proppant fluids of the present invention in an amount in the range of from about 0.1% to about 2% by weight of the liquid component therein.

In certain embodiments, the proppant-free fluid may further comprise a first crosslinking agent and/or the proppant fluid may further comprise a second crosslinking agent, collectively referred to herein as "crosslinking agents." The first and second crosslinking agent may be of the same or of a different composition, provided that the proppant-free fluid and the proppant fluid remain substantially immiscible. The crosslinking agent may be used to crosslink gelling agent molecules to further increase the viscosity of the proppant-free fluid and/or the proppant fluid. The increased viscosity of the fluids may reduce fluid loss and enhance the suspension of proppant aggregates in the proppant fluid, for example. Crosslinking agents typically comprise at least one ion that is capable of crosslinking at least two gelling agent molecules. Examples of suitable crosslinking agents include, but are not limited to, boric acid; disodium octaborate tetrahydrate; sodium diborate; pentaborates; ulexite; colemanite; compounds that can supply zirconium IV ions (e.g., zirconium lactate, zirconium lactate triethanolamine, zirconium carbonate, zirconium acetylacetonate, zirconium malate, zirconium citrate, and zirconium diisopropylamine lactate); compounds that can supply titanium IV ions (e.g., titanium lactate, titanium malate, titanium citrate, titanium ammonium lactate, titanium triethanolamine, and titanium acetylacetonate); aluminum compounds (e.g., aluminum lactate or aluminum citrate); antimony compounds; chromium compounds; iron compounds; copper compounds; zinc compounds; and any combination thereof. An example of a suitable commercially available zirconium-based crosslinking agent is CL-24™ available from Halliburton Energy Services, Inc. in Houston, Tex. An example of a suitable commercially available titanium-based crosslinking agent is CL-39™ available from Halliburton Energy Services, Inc. in Houston, Tex. Suitable crosslinking agents generally are present in the proppant-free and proppant fluids of the present invention in an amount sufficient to provide, in situ, the desired degree of crosslinking between gelling agent molecules. In some embodiments of the present invention, the crosslinking agent may be present in the proppant-free fluids and/or proppant fluids in an amount in the range from about 0.001% to about 10% by weight of the liquid component therein. In other embodiments of the present invention, the crosslinking agent may be present in the proppant-free fluids and/or proppant fluids the proppant-free fluids and proppant fluids in an amount in the range from about 0.01% to about 1% by weight of the liquid component therein. Individuals skilled in the art, with the benefit of this disclosure, will recognize the exact type and amount of crosslinking agent to use depending on factors such as the specific gelling agent used, the desired viscosity of the proppant-free and/or proppant fluids, the formation conditions, and the like.

In some embodiments, the proppant-free fluids may further comprise a first breaker and/or the proppant fluids may further comprise a second breaker, collectively referred to herein as "breakers." The breaker may be an internal gel breaker (e.g., enzyme, oxidizing, acid buffer, and the like) or a delayed gel breaker. The breakers for use in the present invention may cause the gelled proppant-free fluids and/or the gelled proppant fluids to revert to thin fluids that can be produced back to the surface. In some embodiments, the breaker may be formulated to remain inactive until it is "activated" by, among other things, certain conditions in the fluid (e.g., pH, temperature, etc.) and/or interaction with some other substance. In some embodiments, the breaker may be delayed by encapsulation with a coating that delays the release of the breaker (e.g., a porous coating through which the breaker may diffuse slowly, or a degradable coating that degrades in the subterranean formation). In other embodiments the breaker may be a degradable material (e.g., polylactic acid or polygylcolic acid) that releases an acid or alcohol in the presence of an aqueous liquid. In certain embodiments, the breaker may be present in the proppant-free fluids and/or proppant fluids in an amount in the range of from about 0.001% to about 20% by weight of the gelling agent. One of ordinary skill in the art, with the benefit of this disclosure, will recognize the type and amount of breaker to include in the proppant-free and proppant fluids of the present invention based on, among other factors, the desired amount of delay time before the breaking the fluids, the type of gelling agents used, the temperature conditions of a particular application, the desired rate and degree of viscosity reduction, and/or the pH of the fluids. The first and second breakers for use in the proppant-free fluids and proppant fluids, respectively, of the present invention may be identical or different in composition and their propensity to cause the fluids to revert to thin fluids. In preferred embodiments, where a breaker is included in both the proppant-free fluid and the proppant fluid, the breakers are selected such that the proppant fluid reverts to a thin fluid before the proppant-free fluid. This may serve to ensure that the proppant free channels are well formed in the fracture between proppant aggregates.

In certain embodiments, the proppant-free fluid and/or the proppant fluid may further comprise degradable gel bodies, which may be referred to herein as "proppant-free fluid degradable gel bodies" and "proppant fluid degradable gel bodies," respectively, or simply collectively as "degradable gel bodies." The degradable gel bodies may be placed within the fracture with the proppant aggregates and further facilitate the formation of proppant free channels within the proppant pack. Once placed within the fracture, the degradable gel bodies are allowed to break down into a liquid phase and are then removed from the propped fracture, leaving behind proppant free channels between proppant aggregates. The amount of degradable gel bodies included in the proppant-free and/or proppant fluids of the present invention is generally selected to effectively surround the proppant aggregates, despite the two fluids being immiscible. In some embodiments, the degradable gel bodies may be present in an amount of from about 0.5 pounds per gallon ("ppg") to about 30 ppg by volume of the liquid component of the proppant-free or proppant fluid. The degradable gel bodies may additionally prevent or reduce clustering of individual proppant aggregates.

Degradable gel bodies suitable for use in the present invention include those described in U.S. Patent Application Publication Nos. 2010/0089581 and 2011/0067868, the entire disclosures of which are hereby incorporated by reference. One of skill in the art will recognize that some of the degradable gel bodies may be designed to degrade once the facture closes, while other degradable gel bodies may be more resistant to such degradation long after the closing of the fracture.

By way of example, the degradable gel bodies of the present invention may be formed from swellable polymers. Preferably, the swellable particulate is an organic material, such as a polymer or a salt of a polymeric material. Typical examples of polymeric materials include, but are not limited to, a crosslinked polyacrylamide; a crosslinked polyacrylate; a crosslinked copolymer of acrylamide and acrylate; a starch grafted with acrylonitrile and acrylate; a crosslinked polymer of two or more of allylsulfonate, 2-acrylamido-2-methyl-1-propanesulfonic acid, 3-allyloxy-2-hydroxy-1-propanesulfonic acid, acrylamide, acrylic acid; and any combination thereof. Typical examples of suitable salts of polymeric material include, but are not limited to, a salt of carboxyalkyl starch; a salt of carboxymethyl starch; a salt of carboxymethyl cellulose; a salt of crosslinked carboxyalkyl polysaccharide; a starch grafted with acrylonitrile and acrylate; and any combination thereof. The specific features of the swellable particulate may be chosen or modified to provide a proppant pack or matrix with desired permeability while maintaining adequate propping and filtering capability. These swellable particulates are capable of swelling upon contact with a swelling agent. The swelling agent for the swellable particulate can be any agent that causes the swellable particulate to swell via absorption of the swelling agent. In a preferred embodiment, the swellable particulate is "water swellable," meaning that the swelling agent is water. Suitable sources of water for use as the swelling agent include, but are not limited to, fresh water; brackish water; seawater; brine; and any combination thereof. In another embodiment of the invention, the swellable particulate is "oil swellable," meaning that the swelling agent for the swellable particulate is an organic fluid. Examples of organic swelling agents include, but are not limited to, diesel; kerosene; crude oil; and any combination thereof.

Also by way of example, degradable gel bodies of the present invention may be formed from super-absorbent polymers. Suitable such super-absorbent polymers include, but are not limited to, polyacrylamide; crosslinked poly (meth)acrylate; a non-soluble acrylic polymer; and any combination thereof.

In some embodiments of the present invention, the proppant-free fluid and/or proppant fluid may comprise a breaker, a crosslinking agent, and degradable gel fragments. In one such preferred embodiment, to either the proppant-free fluid or the proppant fluid, the breaker is first added, followed by the crosslinking agent, and thereafter followed by the degradable gel bodies. In another preferred embodiment, to either the proppant-free fluid or the proppant fluid, the breaker is first added, followed by the degradable gel bodies, and thereafter followed by the crosslinking agent.

The proppant aggregates of the present invention are formed from individual proppant material. As used herein, the term "proppant aggregate(s)" or "aggregate(s)" refers to a coherent body, such that when the aggregate is placed into a subterranean formation (e.g., into a fracture) or into a fluid (e.g., the proppant fluid of the present invention), it does not become dispersed into smaller bodies without the application of shear. The immiscibility of the proppant-free fluid and the proppant fluid of the present invention may encourage the collection of individual proppant into proppant aggregates. This may be preferred, as it requires no additional steps to perform the methods of the present invention. Additionally, the presence of proppant particulates that have not formed into proppant aggregates will not adversely affect the methods of the present invention. Optionally, the proppant aggregates may be pre-formed or formed on-the-fly at the wellbore site with the use of a binding agent that is capable of being coated onto the proppant particulates and that exhibits a sticky or tacky character such that the proppant particulates tend to create aggregates. As used herein, the term "tacky," in all of its forms generally refers to a substance having a nature such that it is (or may be activated to become) somewhat sticky to the touch. Depending on the particular application, one of skill in the art will recognize the procedure for use in forming the proppant aggregates of the present invention to achieve such application.

Proppant particulates suitable for use in forming the proppant aggregates of the present invention may be of any size and shape combination known in the art as suitable for use in a subterranean operation (e.g., drilling, fracturing, and the like). Generally, where the chosen proppant is substantially spherical, suitable proppant particulates have a size in the range of from about 2 to about 400 mesh, U.S. Sieve Series. In some embodiments of the present invention, the proppant particulates have a size in the range of from about 8 to about 120 mesh, U.S. Sieve Series. There is generally no need for the proppant particulates of the present invention to be sieved or screened to a particular or specific mesh size or particular size distribution, but rather a wide or broad size distribution can be used. The proppant particulates may be included in any concentration suitable for use in a particular subterranean operation. In some embodiments, the proppant particulates may be present in an amount of from about 0.5 pounds per gallon ("ppg") to about 30 ppg by volume of the proppant fluid. In preferred embodiments, the proppant particulates may be present in an amount of from about 22 ppg to about 24 ppg by volume of the proppant fluid. The degradable gel bodies may additionally prevent or reduce clustering of individual proppant aggregates.

In some embodiments of the present invention, it may be desirable to use substantially non-spherical proppant particulates to form the proppant aggregates. Suitable substantially non-spherical proppant particulates may be cubic, polygonal, fibrous, or any other non-spherical shape. Such substantially non-spherical proppant particulates may be, for example, cubic-shaped, rectangular-shaped, rod-shaped, ellipse-shaped, cone-shaped, pyramid-shaped, or cylinder-shaped. That is, in embodiments wherein the proppant particulates are substantially non-spherical, the aspect ratio of the material may range such that the material is fibrous to such that it is cubic, octagonal, or any other configuration. Substantially non-spherical proppant particulates are generally sized such that the longest axis is from about 0.02 inches to about 0.3 inches in length. In other embodiments, the longest axis is from about 0.05 inches to about 0.2 inches in length. In one embodiment, the substantially non-spherical proppant particulates are cylindrical having an aspect ratio of about 1.5 to 1 and about 0.08 inches in diameter and about 0.12 inches in length. In another embodiment, the substantially non-spherical proppant particulates are cubic having sides about 0.08 inches in length. The use of substantially non-spherical proppant particulates may be desirable in some embodiments of the present invention because, among other things, they may allow better packing of individual proppant particulates to form proppant aggregates and they may provide a lower rate of settling when suspended in the proppant fluid of the present invention.

Proppant particulates suitable for use in the present invention may comprise any material suitable for use in subterranean operations. Suitable materials for these proppant particulates include, but are not limited to, sand; bauxite; ceramic material; glass material; polymer material (e.g., ethylene-vinyl acetate); polytetrafluoroethylene material; nut shell pieces; cured resinous particulates comprising nut shell pieces; seed shell pieces; cured resinous particulates comprising seed shell pieces; fruit pit pieces; cured resinous particulates comprising fruit pit pieces; wood; composite particulates; and any combination thereof. Suitable composite particulates may comprise a binding agent and a filler material wherein suitable filler materials include, but are not limited to, silica; alumina; fumed carbon; carbon black; graphite; mica; titanium dioxide; barite; meta-silicate; calcium silicate; kaolin; talc; zirconia; boron; fly ash; hollow glass microspheres; solid glass; and any combination thereof.

The binding agent material for use in the composite particulates may be the same binding agent used to aid in the formation of the proppant aggregates, if used. Suitable binding agents for use in the methods of the present invention include, but are not limited to, a non-aqueous tackifying agent; an aqueous tackifying agent; a silyl-modified polyamide; a resin; a crosslinkable aqueous polymer composition; a polymerizable organic monomer composition; a consolidating agent emulsion; a binder; any derivative thereof; and any combination thereof. As used herein, the term "derivative" refers to any compound that is made from one of the listed compounds, for example, by replacing one atom in one of the listed compounds with another atom or group of atoms, ionizing one of the listed compounds, or creating a salt of one of the listed compounds. The type and amount of binding agent included in a particular method of the present invention may depend upon, among other factors, the composition and/or temperature of the subterranean formation, the flow rate of fluids in the formation, the effective porosity and/or permeability of the subterranean formation, pore throat size and distribution, and the like. Furthermore, the concentration of the binding agent can be varied to, inter alia, enhance the coating of the binding agent onto proppant particulates and/or filler material to encourage the formation of aggregates. It is within the ability of one skilled in the art, with the benefit of this disclosure, to determine the type and amount of binding agent to include in the methods of the present invention to achieve the desired results.

In certain embodiments, the proppant-free fluid and/or the proppant fluid may further comprise an additive. One or more additives may be selected on the particular subterranean operation, the particular subterranean formation, the fluids used, and the like. Suitable additives include, but are not limited to, a salt; a weighting agent; a fluid loss control agent; an emulsifier; a dispersion aid; a corrosion inhibitor; an emulsion thinner; an emulsion thickener; a surfactant; a particulate; a lost circulation material; a foaming agent; a gas; a pH control additive; a biocide; a stabilizer; a scale inhibitor; a friction reducer; a clay stabilizing agent; and any combination thereof.

FIG. 1A is a schematic view of an equipment embodiment of the methods of the present invention for delivering proppant-free fluid and proppant fluid simultaneously into a wellbore as could be used in the field. Although this is a representative embodiment, other delivery mechanisms may be utilized. Proppant-free fluid 100 is housed in storage tank 10, which may stationarily house proppant-free fluid 100 or may continuously or intermittently mix proppant-free fluid 100 while it is housed therein. Storage tank 10 is connected to conduit 120, which may be a tubing, piping, or other channel for conveying the proppant-free fluid 100 to pressurized pump 130 and thereafter into wellbore 180. Placed in fluid communication with conduit 120, prior to reaching pressurized pump 130, may be three additional conduits. First, conduit 140 may be in fluid communication with conduit 120 and may allow breaker 30 in storage tank 200 and pumped into conduit 140 through pressurized pump 210 to be included in proppant-free fluid 100 in conduit 120. Second, conduit 160 may be in fluid communication with conduit 120 and may allow crosslinking agent 40 in storage tank 220 and pumped into conduit 160 through pressurized pump 230 to be included in proppant-free fluid 100 in conduit 120. Third, conduit 170 may be in fluid communication with conduit 120 and may allow degradable gel bodies 50 in storage tank 240 and pumped into conduit 170 through pressurized pump 250 to be included in proppant-free fluid 100 in conduit 120.

In FIG. 1A, proppant fluid 110 is housed in storage tank 20, which may stationarily house proppant fluid 110 or may continuously or intermittently mix proppant fluid 110 while it is housed therein. Storage tank 20 is connected to conduit 190, which may be a tubing, piping, or other channel for conveying the proppant fluid 110 to pressurized pump 260 and thereafter to conduit 120 at meeting point 280, which is in fluid communication with wellbore 180. Optionally placed in fluid communication with conduit 190, prior to reaching pressurized pump 260, may be three additional conduits. First, conduit 270 may be in fluid communication with conduit 190 and may allow breaker 30 in storage tank 200 and pumped into conduit 270 through pressurized pump 210 to be included in proppant fluid 110 in conduit 190. Second, conduit 290 may be in fluid communication with conduit 190 and may allow crosslinking agent 40 in storage tank 220 and pumped into conduit 290 through pressurized pump 230 to be included in proppant fluid 110 in conduit 190. Third, conduit 310 may be in fluid communication with conduit 190 and may allow degradable gel bodies 50 in storage tank 240 and pumped into conduit 310 through pressurized pump 250 to be included in proppant fluid 110 in conduit 190.

Figure 1B:
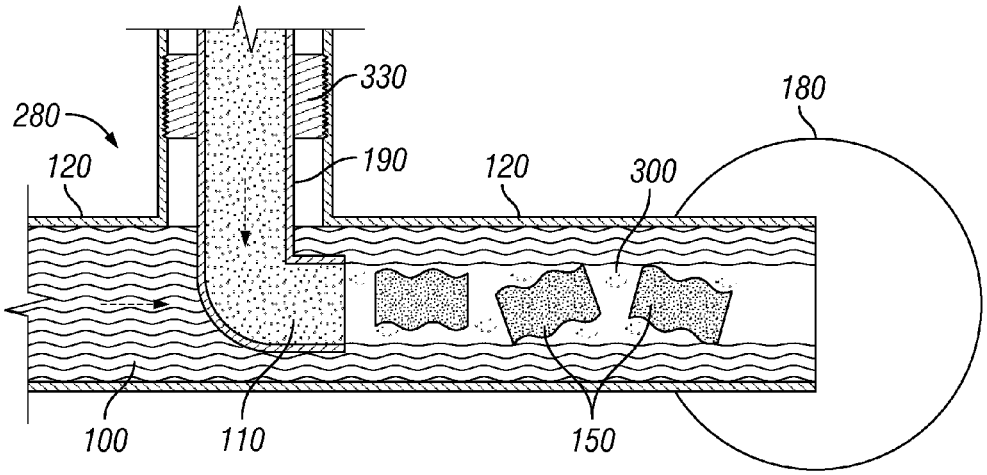
FIG. 1B is a sagittal, detailed schematic view of the mechanism by which the proppant-free fluid and the proppant fluid are simultaneously introduced into a wellbore, wherein proppant aggregates are formed and the two fluids are immiscible.

FIG. 1B is a sagittal, detailed schematic view of the mechanism by which the proppant-free fluid and the proppant fluid are simultaneously introduced into a wellbore, wherein proppant aggregates are formed and the two fluids are immiscible. FIG. 1B is a detailed view of meeting point 280 where conduit 190 meets with conduit 120 through fitting 330 to deposit proppant-free fluid 100 and proppant fluid 110 into wellbore 180. Proppant-free fluid 100 and proppant fluid 110 remain immiscible and the immiscibility of the two fluids causes proppant aggregates 150 to form in the proppant fluid. In some instances, individual proppant particulates 300 may also remain in the proppant fluid.

Embodiments disclosed herein include:

A. A method of treating a fracture in a subterranean formation comprising: providing a proppant-free fluid comprising a first gelling agent; providing a proppant fluid comprising a second gelling agent and proppant aggregates, wherein the proppant-free fluid and the proppant fluid are substantially immiscible; continuously pumping the proppant-free fluid into the subterranean formation; continuously pumping the proppant fluid into the subterranean formation, wherein the proppant-free fluid and the proppant fluid are present simultaneously in a portion of the subterranean formation but remain immiscible; placing the proppant aggregates into a portion of the fracture in the subterranean formation so as to form a proppant pack having proppant-free channels therein.

B. A method of treating a fracture in a subterranean formation comprising: providing a proppant-free fluid comprising a first gelling agent and a first crosslinking agent; providing a proppant fluid comprising a second gelling agent, a breaker, a second crosslinking agent, and proppant aggregates, wherein the proppant-free fluid and the proppant fluid are substantially immiscible; continuously pumping the proppant-free fluid into the subterranean formation; continuously pumping the proppant fluid into the subterranean formation, wherein the proppant-free fluid and the proppant fluid are present simultaneously in a portion of the subterranean formation but remain immiscible; placing the proppant aggregates into a portion of the fracture so as to form a proppant pack having proppant-free channels therein.

C. A method of treating a fracture in a subterranean formation comprising: providing a proppant-free fluid comprising a first gelling agent, a first breaker, a first crosslinking agent, and proppant-free fluid degradable gel bodies; providing a proppant fluid comprising a second gelling agent, a second breaker, a second crosslinking agent, proppant fluid degradable gel bodies, and proppant aggregates, wherein the proppant-free fluid and the proppant fluid are substantially immiscible; continuously pumping the proppant-free fluid into the subterranean formation; continuously pumping the proppant fluid into the subterranean formation, wherein the proppant-free fluid and the proppant fluid are present simultaneously in a portion of the subterranean formation but remain immiscible; placing the proppant aggregates and the degradable gel bodies into a portion of the fracture so as to form a proppant pack having proppant-free channels therein.

Each of embodiments A, B, and C may have one or more of the following additional elements in any combination:

Element 1: Wherein the fracture is created or enhanced during the step of pumping the proppant-free fluid into the subterranean formation by pumping the proppant-free fluid at a rate and pressure sufficient to create or enhance the fracture.

Element 2: Wherein the proppant aggregates comprise proppant particulates and a binding agent selected from the group consisting of a non-aqueous tackifying agent; an aqueous tackifying agent; a silyl-modified polyamide; a resin; a crosslinkable aqueous polymer composition; a polymerizable organic monomer composition; a consolidating agent emulsion; a binder; any derivative thereof; and any combination thereof.

Element 3: Wherein the first gelling agent is present in an amount in the range of from about 0.01% to about 5% by weight of liquid component of the proppant-free fluid.

Element 4: Wherein the second gelling agent is present in an amount in the range of from about 0.01% to about 5% by weight of liquid component of the proppant fluid.

Element 5: Wherein the first breaker is present in an amount in the range of from about 0.001% to about 20% by weight of the first gelling agent.

Element 6: Wherein the second breaker is present in an amount in the range of from about 0.001% to about 20% by weight of the second gelling agent.

Element 7: Wherein the first crosslinking agent is present in an amount in the range of from about 0.001% to about 10% by weight of liquid component of the proppant-free fluid.

Element 8: Wherein the second crosslinking agent is present in an amount in the range of from about 0.001% to about 10% by weight of liquid component of the proppant fluid.

Element 9: Wherein the proppant fluid further comprises degradable gel bodies and wherein the degradable gel bodies are placed into the portion of the fracture simultaneously with the placement of the proppant aggregates.

Element 10: Wherein the second breaker in the proppant fluid is activated prior to activating the first breaker in the proppant-free fluid.

By way of non-limiting example, exemplary combinations applicable to A, B, C include: A with 1, 5, 7, and 9; B with 2, 3, and 4; C with 1 and 10.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method of treating a fracture in a subterranean formation comprising:

providing a proppant-free fluid comprising a first gelling agent;

providing a proppant fluid comprising a second gelling agent and proppant particulates, wherein the proppant-free fluid and the proppant fluid are substantially immiscible;

continuously pumping the proppant-free fluid through a first conduit;

continuously pumping the proppant fluid through a second conduit, and adding a breaker into the proppant fluid through the second conduit, wherein the second conduit extends into the first conduit through a fitting at a location outside of the subterranean formation, and the proppant-free fluid and the proppant fluid are simultaneously introduced into the subterranean formation through the first conduit together without pulsing or intermittent pumping, wherein the proppant-free fluid and the proppant fluid are present simultaneously in a portion of the subterranean formation but remain immiscible, and wherein the immiscibility of the proppant-free fluid and the proppant fluid causes the proppant particulates to aggregate into proppant aggregates;

placing the proppant aggregates into a portion of the fracture in the subterranean formation so as to form a proppant pack having proppant-free channels therein.

2. The method of claim 1, wherein the fracture is created or enhanced during the step of pumping the proppant-free fluid into the subterranean formation by pumping the proppant-free fluid at a rate and pressure sufficient to create or enhance the fracture.

3. The method of claim 1, wherein the proppant particulates are coated with a binding agent selected from the group consisting of a non-aqueous tackifying agent; an aqueous tackifying agent; a silyl-modified polyamide; a resin; a crosslinkable aqueous polymer composition; a polymerizable organic monomer composition; a consolidating agent emulsion; a binder; any derivative thereof; and any combination thereof.

4. The method of claim 1, wherein the first gelling agent is present in an amount in the range of from about 0.01% to about 5% by weight of liquid component of the proppant-free fluid and wherein the second gelling agent is present in an amount in the range of from about 0.01% to about 5% by weight of liquid component of the proppant fluid.

5. A method of treating a fracture in a subterranean formation comprising:

providing a proppant-free fluid comprising a first gelling agent and a first crosslinking agent;

providing a proppant fluid comprising a second gelling agent and proppant particulates, wherein the proppant-free fluid and the proppant fluid are substantially immiscible;

continuously pumping the proppant-free fluid through a first conduit;

continuously pumping the proppant fluid into a second conduit, and adding a breaker and a second crosslinking agent into the proppant fluid through the second conduit, wherein the second conduit extends into the first conduit through a fitting at a location outside of the subterranean formation, and the proppant-free fluid and the proppant fluid are simultaneously introduced into the subterranean formation through the first conduit together without pulsing or intermittent pumping, wherein the proppant-free fluid and the proppant fluid are present simultaneously in a portion of the subterranean formation but remain immiscible, and wherein the immiscibility of the proppant-free fluid and the proppant fluid causes the proppant particulates to aggregate into proppant aggregates;

placing the proppant aggregates into a portion of the fracture so as to form a proppant pack having proppant-free channels therein.

6. The method of claim 5, wherein the fracture is created or enhanced during the step of pumping the proppant-free fluid into the subterranean formation by pumping the proppant-free fluid at a rate and pressure sufficient to create or enhance the fracture.

7. The method of claim 5, wherein the proppant particulates are coated with a binding agent selected from the group consisting of a non-aqueous tackifying agent; an aqueous tackifying agent; a silyl-modified polyamide; a resin; a crosslinkable aqueous polymer composition; a polymerizable organic monomer composition; a consolidating agent emulsion; a binder; any derivative thereof; and any combination thereof.

8. The method of claim 5, wherein the first gelling agent is present in an amount in the range of from about 0.01% to about 5% by weight of liquid component of the proppant-free fluid and wherein the second gelling agent is present in an amount in the range of from about 0.01% to about 5% by weight of liquid component of the proppant fluid.

9. The method of claim 5, wherein the breaker in the proppant fluid is present in an amount in the range of from about 0.001% to about 20% by weight of the second gelling agent.

10. The method of claim 5, wherein the first crosslinking agent is present in an amount in the range of from about 0.001% to about 10% by weight of liquid component of the proppant-free fluid and wherein the second crosslinking agent is present in an amount in the range of from about 0.001% to about 10% by weight of liquid component of the proppant fluid.

11. The method of claim 5, wherein the proppant fluid further comprises degradable gel bodies and wherein the degradable gel bodies are placed into the portion of the fracture simultaneously with the placement of the proppant aggregates.

12. A method of treating a fracture in a subterranean formation consisting of:

providing a proppant-free fluid comprising a first gelling agent, a first breaker, a first crosslinking agent, and proppant-free fluid degradable gel bodies;

providing a proppant fluid comprising a second gelling agent and proppant particulates, wherein the proppant-free fluid and the proppant fluid are substantially immiscible;

continuously pumping the proppant-free fluid through a first conduit;

continuously pumping the proppant fluid through a second conduit, and adding a second breaker, a second crosslinking agent, and proppant fluid degradable gel bodies into the proppant fluid through the second conduit, wherein the second conduit extends into the first conduit through a fitting at a location outside of the subterranean formation, and the proppant-free fluid and the proppant fluid are simultaneously introduced into the subterranean formation through the first conduit together without pulsing or intermittent pumping, wherein the proppant-free fluid and the proppant fluid are present simultaneously in a portion of the subterranean formation but remain immiscible, and wherein the immiscibility of the proppant-free fluid and the proppant fluid causes the proppant particulates to aggregate into proppant aggregates;

placing the proppant aggregates and the degradable gel bodies into a portion of the fracture so as to form a proppant pack having proppant-free channels therein.

13. The method of claim 12, wherein the fracture is created or enhanced during the step of pumping the proppant-free fluid into the subterranean formation by pumping the proppant-free fluid at a rate and pressure sufficient to create or enhance the fracture.

14. The method of claim 12, wherein the second breaker in the proppant fluid is activated prior to activating the first breaker in the proppant-free fluid.

15. The method of claim 12, wherein the proppant particulates are coated with a binding agent selected from the group consisting of a non-aqueous tackifying agent; an aqueous tackifying agent; a silyl-modified polyamide; a resin; a crosslinkable aqueous polymer composition; a polymerizable organic monomer composition; a consolidating agent emulsion; a binder; any derivative thereof; and any combination thereof.

16. The method of claim 12, wherein the first gelling agent is present in an amount in the range of from about 0.01% to about 5% by weight of liquid component of the proppant-free fluid and wherein the second gelling agent is present in an amount in the range of from about 0.01% to about 5% by weight of liquid component of the proppant fluid.

17. The method of claim 12, wherein the first breaker is present in the proppant-free fluid in an amount in the range of from about 0.001% to about 20% by weight of the first gelling agent and wherein the second breaker is present in the proppant fluid in an amount in the range of from about 0.001% to about 20% by weight of the second gelling agent.

18. The method of claim 12, wherein the first crosslinking agent is present in an amount in the range of from about 0.001% to about 10% by weight of liquid component of the proppant-free fluid and wherein the second crosslinking agent is present in an amount in the range of from about 0.001% to about 10% by weight of liquid component of the proppant fluid.

19. The method of claim 12, wherein the proppant-free fluid degradable gel bodies are present in an amount in the range of from about 0.5 ppg to about 30 ppg by volume of liquid component of the proppant-free fluid and wherein the proppant fluid degradable gel bodies are present in an amount in the range of from about 0.5 ppg to about 30 ppg by volume of liquid component of the proppant fluid.

20. The method of claim 12, wherein the degradable gel bodies in the proppant fluid are placed into the portion of the fracture simultaneously with the placement of the proppant aggregates.

* * * * *